US009570800B2

(12) United States Patent
Jang et al.

(10) Patent No.: US 9,570,800 B2
(45) Date of Patent: Feb. 14, 2017

(54) GROUND ANTENNA AND GROUND RADIATOR USING CAPACITOR

(71) Applicants: Hyun Min Jang, Jecheon-si (KR); Hyeng Cheul Choi, Seoul (KR); Dong Ryeol Lee, Seoul (KR); Yang Liu, Seoul (KR); Hyung Jin Lee, Ansan-si (KR); Jae Kyu Yu, Namyangju-si (KR)

(72) Inventors: Hyun Min Jang, Jecheon-si (KR); Hyeng Cheul Choi, Seoul (KR); Dong Ryeol Lee, Seoul (KR); Yang Liu, Seoul (KR); Hyung Jin Lee, Ansan-si (KR); Jae Kyu Yu, Namyangju-si (KR)

(73) Assignee: RADINA CO., LTD, Seoul (KR)

( * ) Notice: Subject to any disclaimer, the term of this patent is extended or adjusted under 35 U.S.C. 154(b) by 466 days.

(21) Appl. No.: 14/047,008

(22) Filed: Oct. 6, 2013

(65) Prior Publication Data

US 2014/0062820 A1 Mar. 6, 2014

Related U.S. Application Data

(63) Continuation of application No. PCT/KR2012/001027, filed on Feb. 10, 2012.

(30) Foreign Application Priority Data

Apr. 6, 2011 (KR) ..... 10-2011-0031913
Nov. 3, 2011 (KR) ..... 10-2011-0113754

(51) Int. Cl.
*H01Q 9/00* (2006.01)
*H01Q 1/48* (2006.01)
(Continued)

(52) U.S. Cl.
CPC ..... *H01Q 1/48* (2013.01); *H01Q 1/243* (2013.01); *H01Q 13/10* (2013.01)

(58) Field of Classification Search
CPC ..... H01Q 9/145; H01Q 9/30; H01Q 9/14; H01Q 5/0034
(Continued)

(56) References Cited

U.S. PATENT DOCUMENTS

2004/0085245 A1* 5/2004 Miyata ..... H01Q 1/243 343/700 MS
2009/0224996 A1* 9/2009 Kim ..... H01P 1/18 343/860
(Continued)

FOREIGN PATENT DOCUMENTS

EP 1962372 A1 8/2008
EP 1962372 B1 10/2010
(Continued)

OTHER PUBLICATIONS

International Search Report in International Application No. PCT/KR2012/001027, dated Sep. 21, 2012.

*Primary Examiner* — Dameon E Levi
*Assistant Examiner* — Collin Dawkins
(74) *Attorney, Agent, or Firm* — Park, Kim & Suh, LLC

(57) ABSTRACT

By providing a radiator configuration circuit and a feeding circuit each having a simple structure, a ground radiation antenna having a more simplified fabrication process as well as a remarkably reduced fabrication cost is provided herein. Additionally, a ground radiation antenna having an excellent radiation performance, even when one side of a mobile communication terminal is covered with a conductive substance, such as an LCD panel, is also provided herein.

5 Claims, 15 Drawing Sheets

(51) Int. Cl.
*H01Q 1/24* (2006.01)
*H01Q 13/10* (2006.01)

(58) Field of Classification Search
USPC ..... 343/745, 749, 848, 850
See application file for complete search history.

(56) References Cited

U.S. PATENT DOCUMENTS

| | | | | |
|---|---|---|---|---|
| 2010/0060530 | A1* | 3/2010 | Shoji | H01Q 9/145 343/702 |
| 2010/0231472 | A1* | 9/2010 | Tran | H01Q 1/2266 343/742 |
| 2010/0315303 | A1* | 12/2010 | Kearney | H01Q 1/36 343/767 |
| 2011/0032165 | A1* | 2/2011 | Heng | H01Q 7/005 343/745 |

FOREIGN PATENT DOCUMENTS

| | | | |
|---|---|---|---|
| KR | 10-2006-0065638 | A | 6/2006 |
| KR | 10-2008-0112502 | A | 12/2008 |
| KR | 10-2010-0063414 | A | 6/2010 |
| KR | 10-2011-0019666 | A | 2/2011 |

* cited by examiner

GROUND ANTENNA AND GROUND RADIATOR USING CAPACITOR

This application claims the benefit under 35 U.S.C. §120 and §365(c) to a prior PCT International Application No. PCT/KR2012/001027, filed on Feb. 10, 2012, which claims the benefit of Korean Patent Application No. 10-2011-0031913, filed on Apr. 6, 2011, and Korean Patent Application No. 10-2011-0113754, filed on Nov. 3, 2011, the contents of which are all hereby incorporated by reference herein in their entirety.

FIELD OF THE INVENTION

The present invention relates to a ground radiator configuring a ground radiation antenna and, more particularly, to a ground radiator that can remarkably simplify a structure of the ground radiation antenna.

BACKGROUND ART

As a device receiving an RF signal existing in the air inside a user terminal or transmitting a signal existing inside the user terminal to the outside, an antenna corresponds to an essential device used in wireless communication. Recently, as mobile communication terminals have become more compact and light-weight, the antenna has also been required to become slimmer. Additionally, as the amount of data being wirelessly transmitted/received has increased, antennae having more enhanced performance are also being required.

Accordingly, an antenna using ground radiation, which is included in the user terminal itself, has been proposed in order to meet such requirements. More specifically, when the antenna is configured by using a ground of the terminal itself as a portion of a radiator, the size of the radiator, which occupies the largest space within the antenna, may be reduced, thereby contributing to realizing a compact size of the antenna.

As described above, European Patent No. 1962372 corresponds to a prior art technology, which is related to a ground radiation antenna using the ground of the user terminal itself as the radiator. This patent proposes a technology for designing an antenna using a ground of a user terminal, when a body of the user terminal, such as a folder type user terminal, is configured to be divided into two sub-bodies, and when each body is configured to be connected to one another through an electrical element, such as an FPCB.

According to this patent, in a folder type user terminal having a body, which is divided into two sub-bodies, a capacitor for tuning a resonance frequency is inserted in an electric conductor for performing inductive coupling between the two sub-bodies.

Therefore, the above-described antenna shall only be used in a user terminal (e.g., folder type user terminal) being configured of two sub-bodies, and, since the electric conductor for inductive coupling is decided to have a constant length, there lie many problems in that the structure is not simple, and that the scope of devices that can be applied is also very limited.

FIG. 1 illustrates an exemplary structural view of a related art ground radiation antenna. Referring to FIG. 1, the related art ground radiation antenna (10) is equipped with a radiation structure (11) for helping (or aiding) ground radiation, as shown in FIG. 1. More specifically, the radiation structure (11) corresponds to a complex structure consisting of a dielectric substance and conduction lines. And, in order to manufacture such a complex structure, a considerable amount of fabrication cost and complex fabrication process have been required. Additionally, in addition to the radiation structure (11), the ground radiation antenna is also configured of an inductor and capacitor (12*a*, 12*b*, 12*c*) for impedance matching and radiation performance control.

Therefore, although the related art ground radiation antenna uses the ground as its radiator, it still requires a separate radiation structure having a complex structure. And, in order to implement such a radiation structure, a considerable amount of fabrication cost has been required. Moreover, as the radiation structure of the antenna becomes more complex, there have been limitations in creating slimmer user terminals.

Most particularly, the related art ground radiation antenna is disadvantageous in that the essential phenomenon of ground radiation was not fully nor well understood, and, accordingly, due to an unnecessarily complex structure for implementing such ground radiation, the fabrication cost has increased, and the fabrication process has become complicated.

DETAILED DESCRIPTION OF THE INVENTION

Technical Objects

An object of the present invention is to simplify the fabrication process, to create a slimmer antenna, and to remarkably reduce the fabrication cost, by removing the radiation structure having a complex structure and by implementing the ground radiator using only simple elements.

Technical Solutions

The present invention provides a ground radiator having a more remarkably simplified structure by using a capacitance of a capacitor and an inductance of a ground.

Additionally, in the ground radiator, the present invention provides a ground radiator that is generated by using only a capacitive element without using a separate radiation structure.

Furthermore, by spacing apart at least a portion of a radiator configuration circuit from a ground substrate at a predetermined distance, the present invention provides a ground radiator having excellent radiation performance, even when a surface of a mobile communication terminal is covered with a conductive substance.

Advantageous Effects

According to the present invention, an antenna having an excellent radiation performance, while remarkably simplifying the structure of an antenna that is capable of performing ground radiation, may be provided.

Additionally, according to the present invention, by remarkably simplifying the structure of the radiator, the fabrication cost may be minimized, and the fabrication process may become easier and simpler.

Furthermore, according to the present invention, an antenna having an excellent radiation performance may be provided, even when a surface of a mobile communication terminal is covered with a conductive substance, such as LCD.

BRIEF DESCRIPTION OF THE PRESENT INVENTION

Figure 5A:
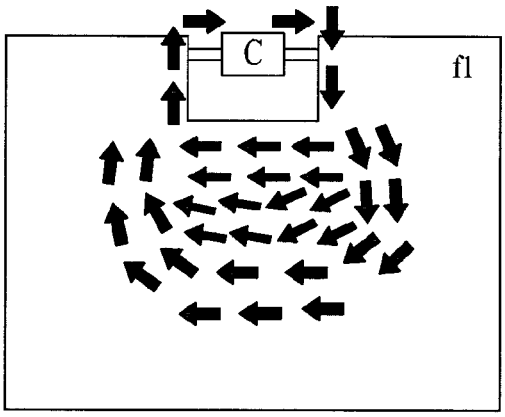
Figure 5B:
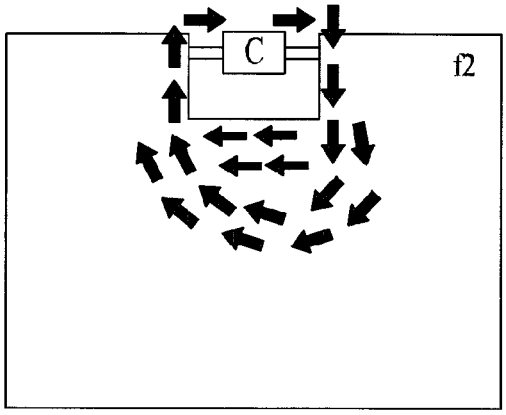
Figure 5C:
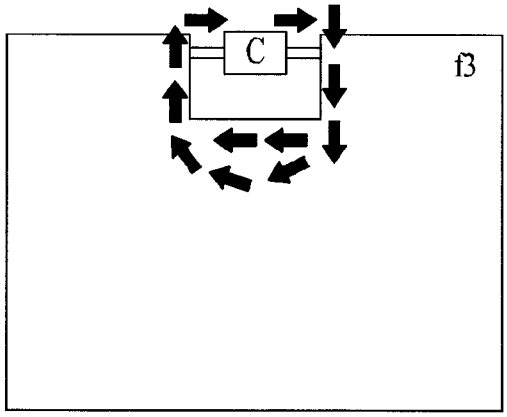
Figure 6:
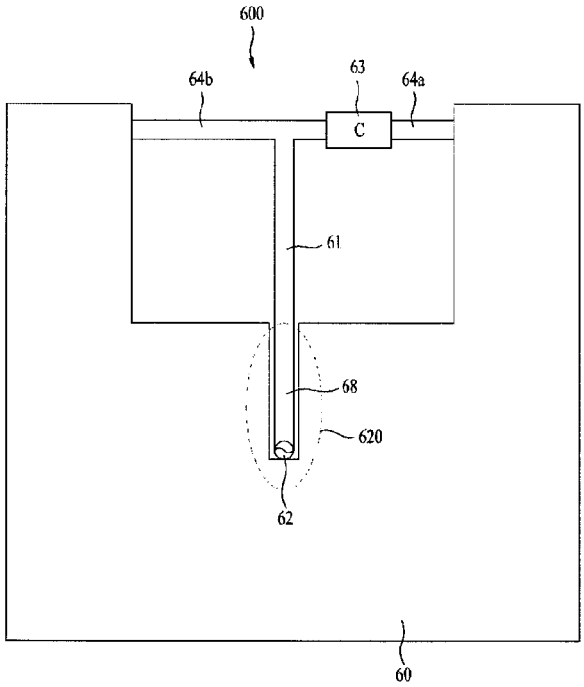
Figure 7:
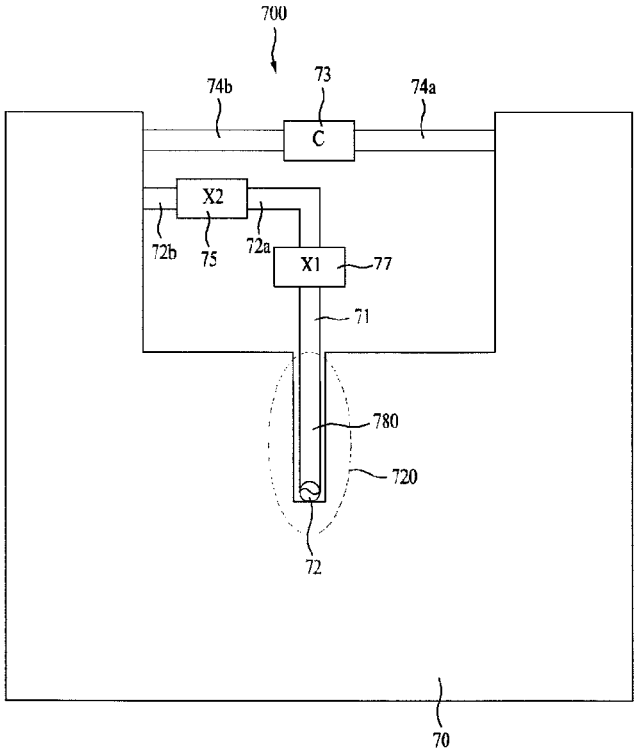
Figure 8:
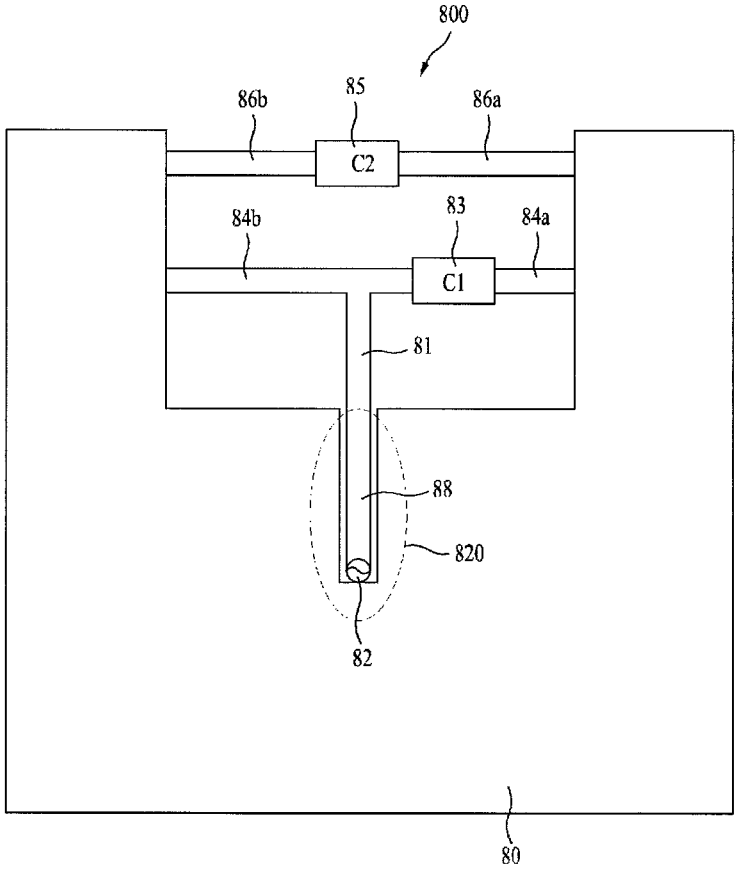
Figure 9:
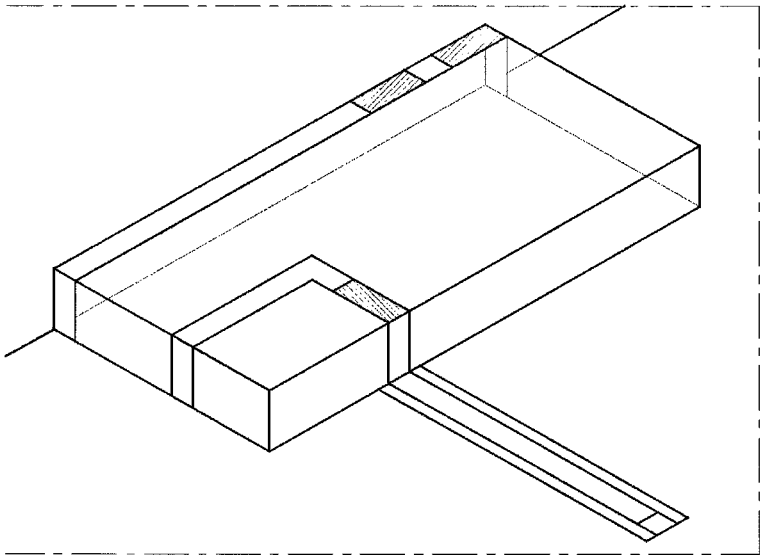
Figure 10:
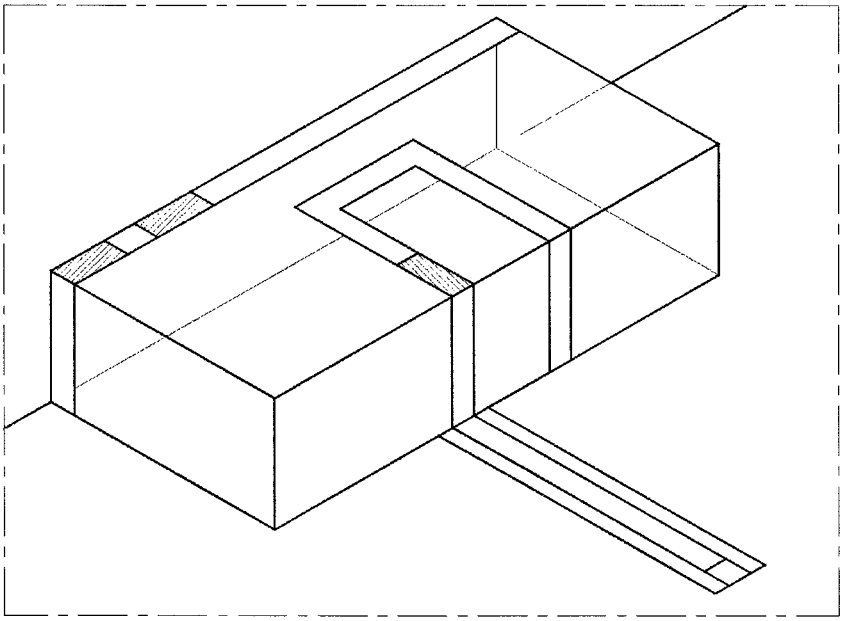
Figure 11:
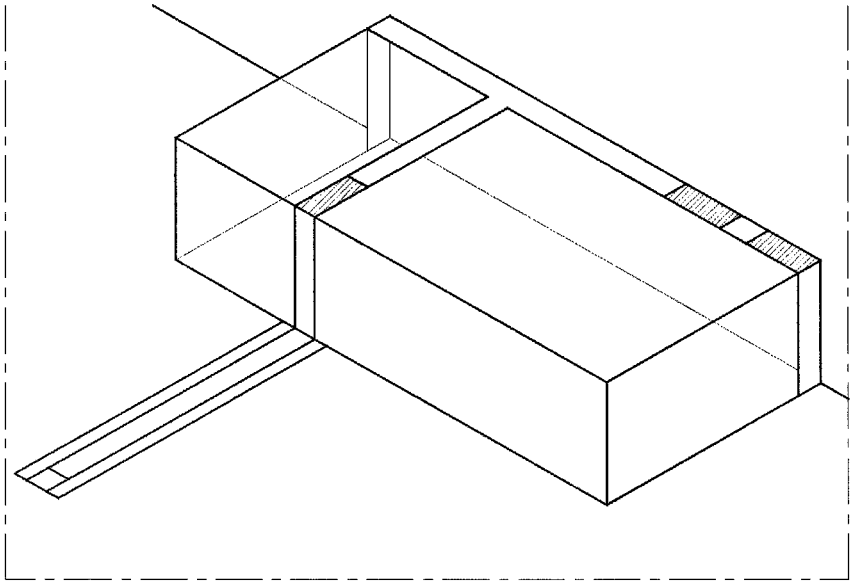
Figure 12A:
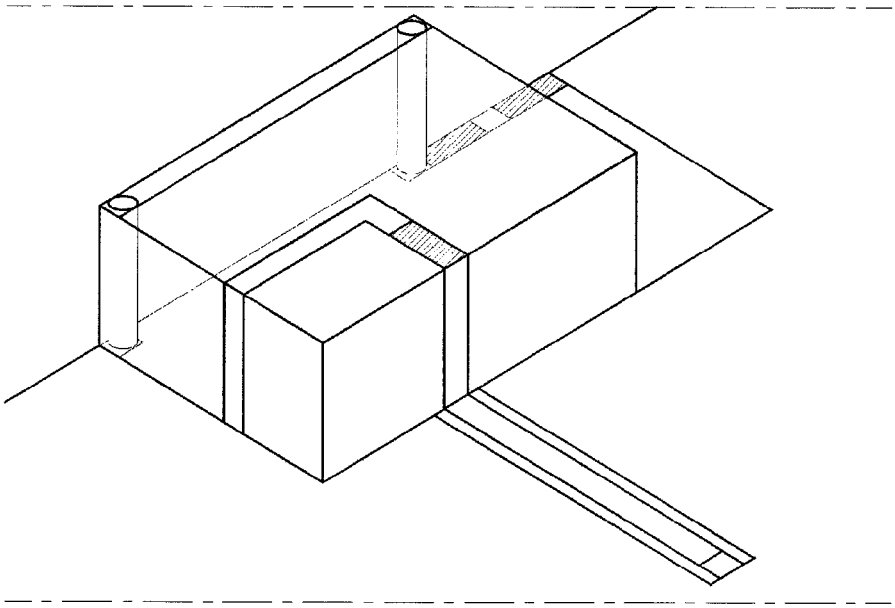
Figure 12B:
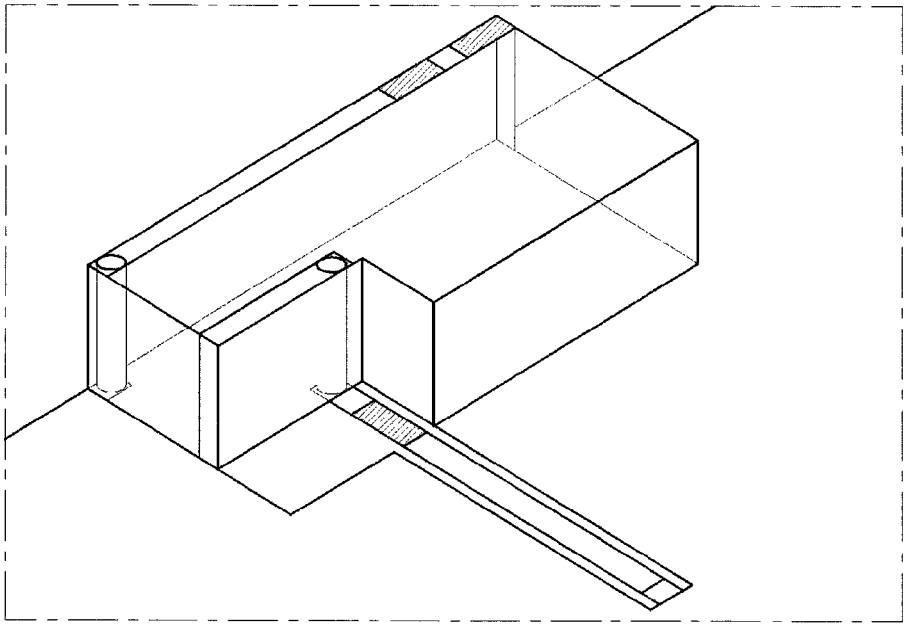
Figure 12C:
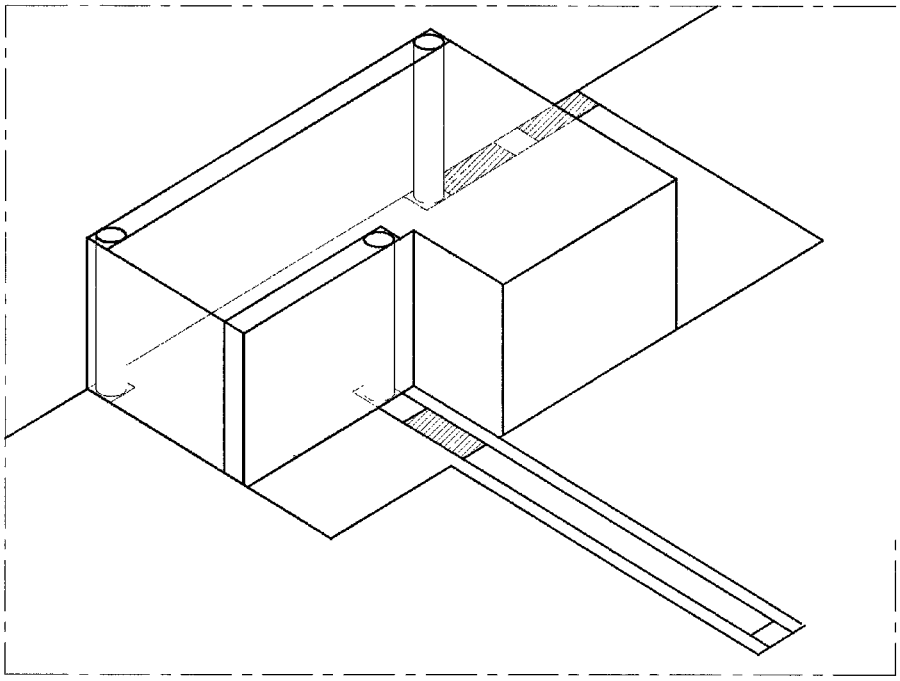
Figure 13:
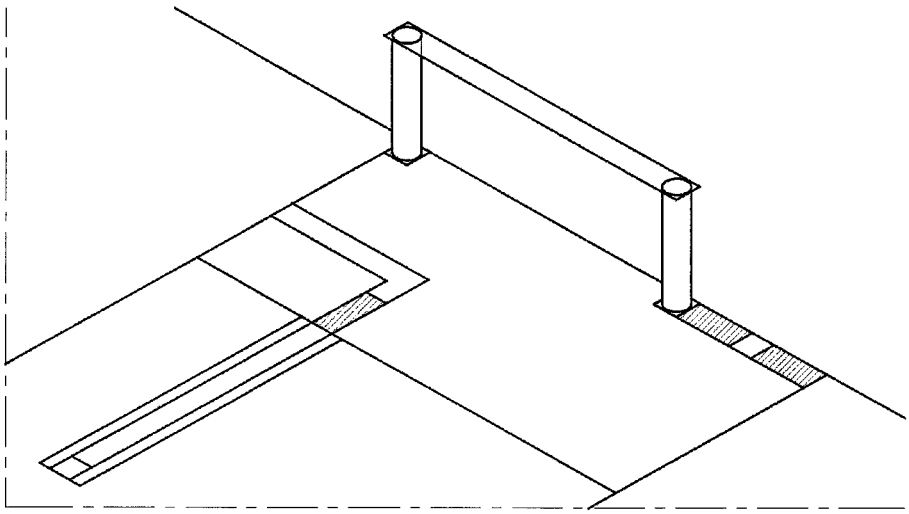
Figure 14:
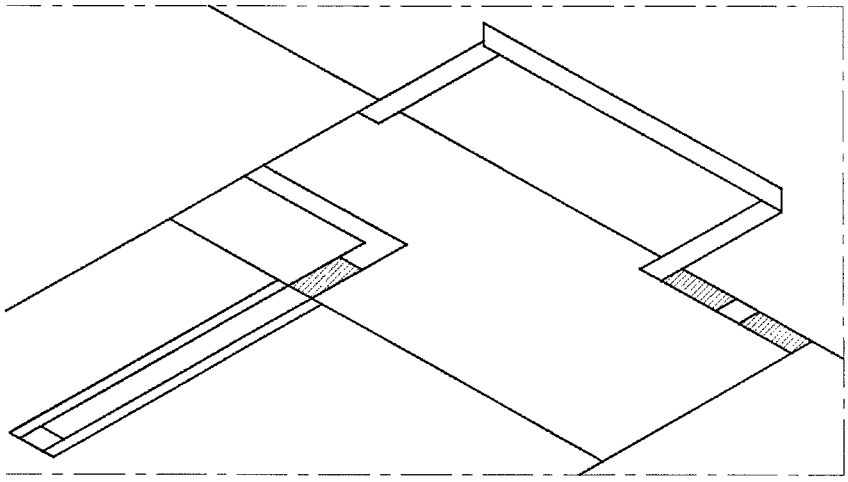
Figure 15:
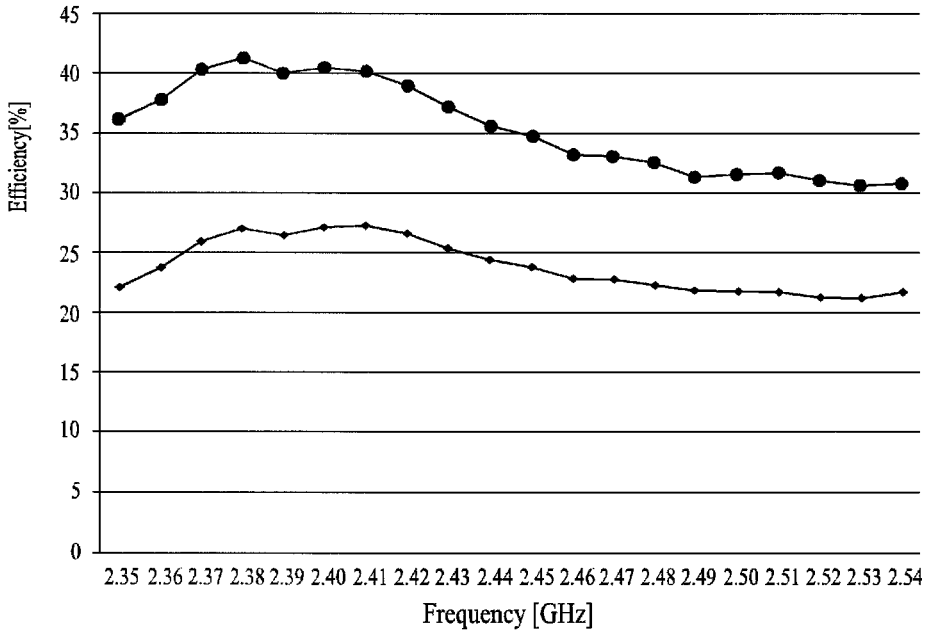
Figure 16:
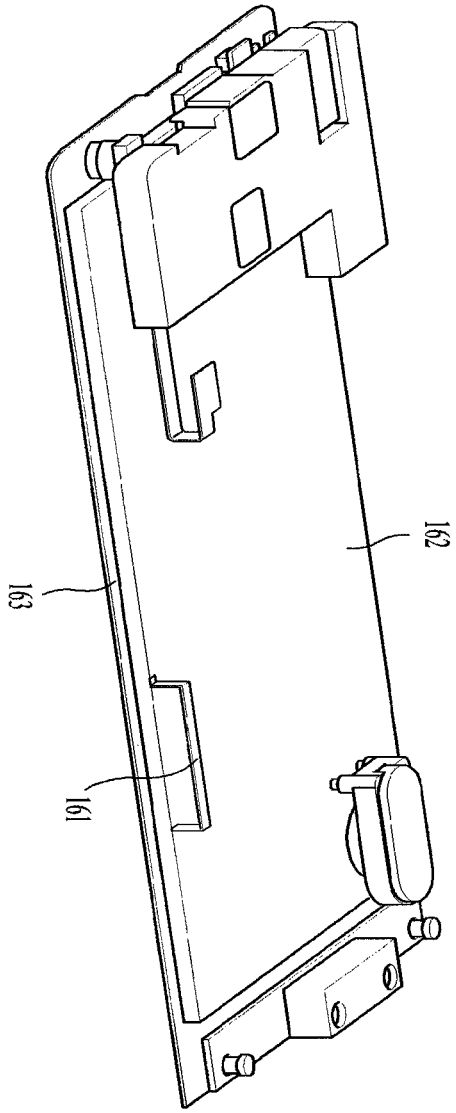
Figure 17:
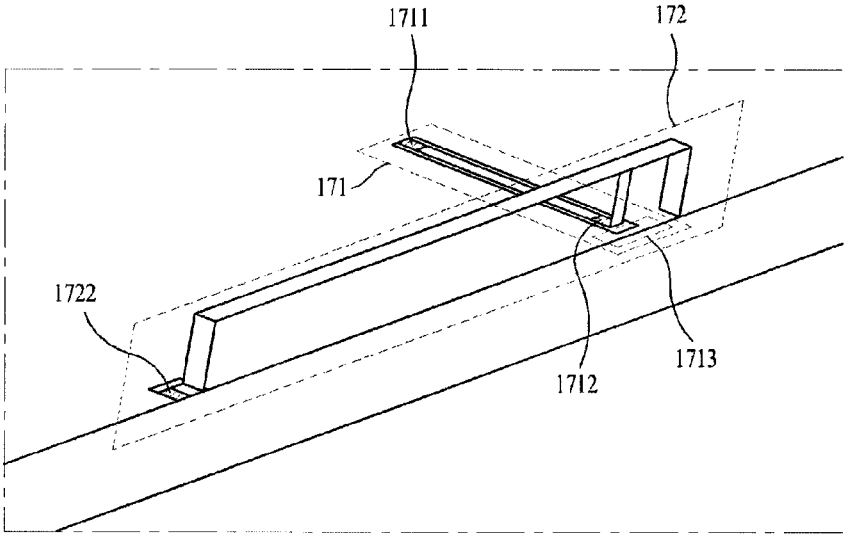
Figure 18:
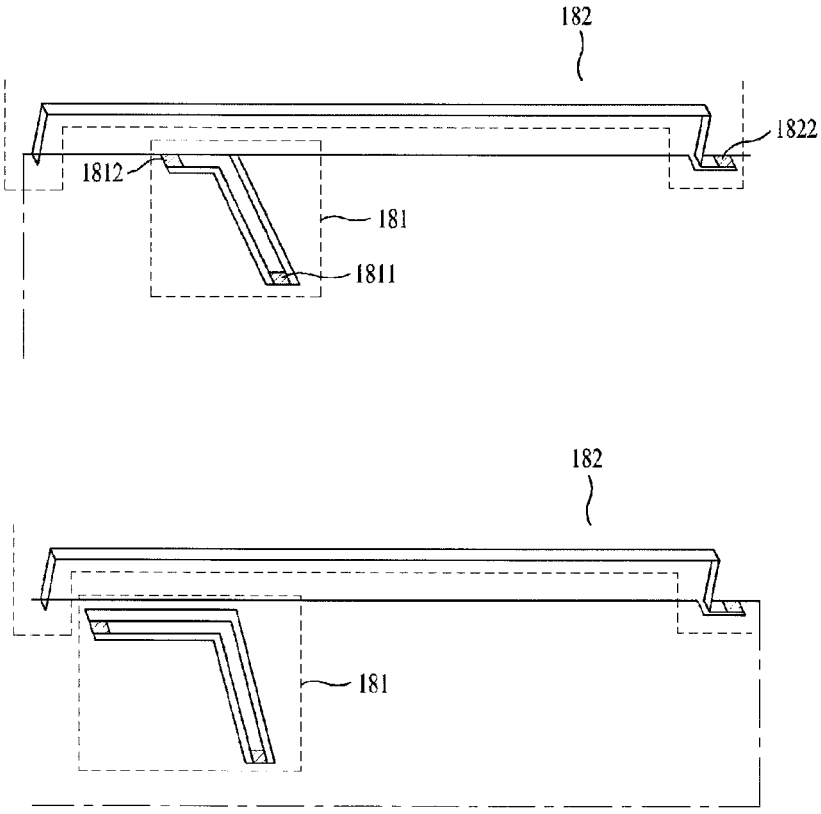
Figure 19:
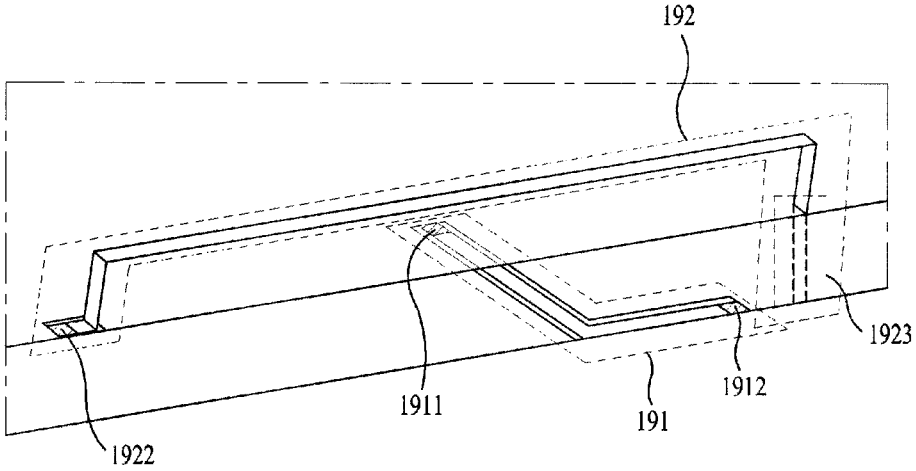
Figure 20:
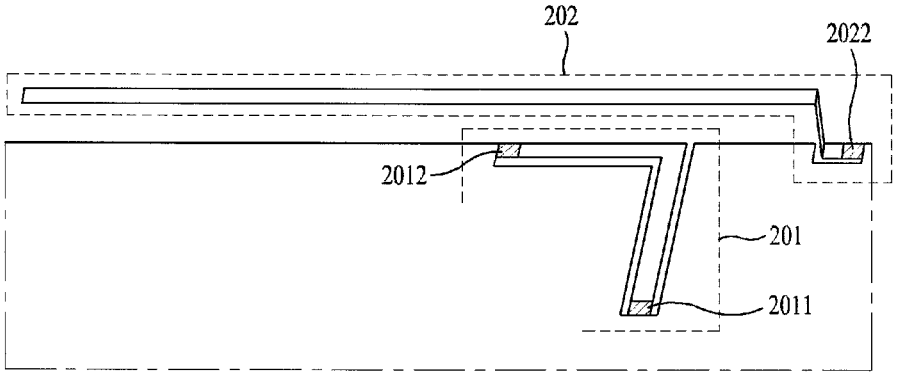
Figure 21:
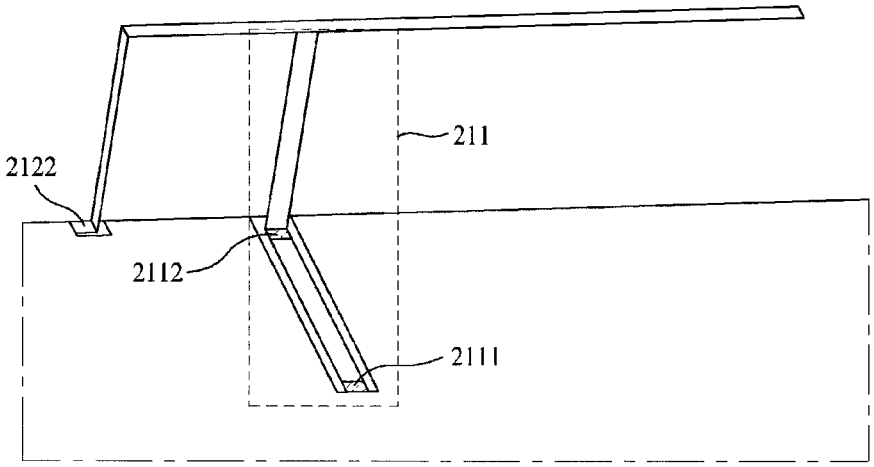
Figure 22:
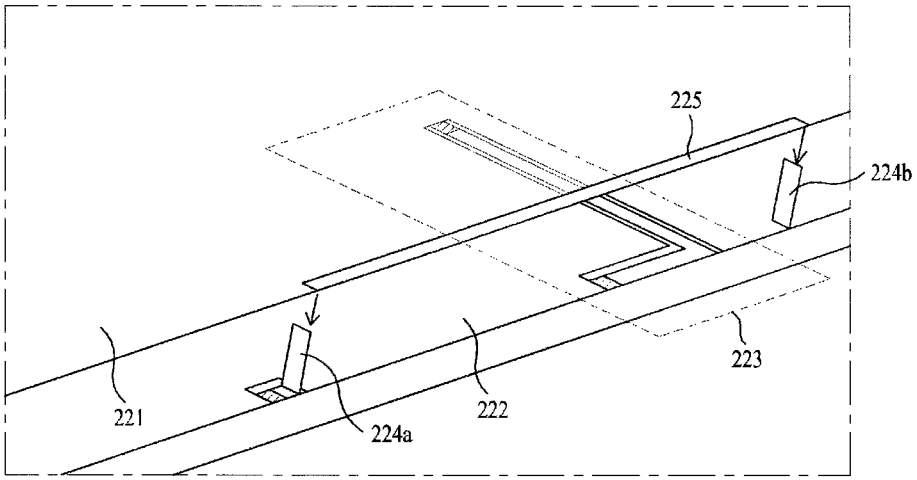

Each of FIGS. 5A, 5B, and 5C illustrates an electric current distribution respective to a frequency being fed to the ground radiator;

FIG. 6 illustrates a ground antenna having a ground radiator being configured as a single body with a feeding circuit according to an embodiment of the present invention;

FIG. 7 illustrates an antenna using an antenna radiator according to the present invention;

FIG. 8 illustrates a ground antenna having a ground radiator and a feeding circuit each being separately configured according to an exemplary embodiment of the present invention;

FIG. 9 illustrates an antenna using the antenna radiator according to the present invention, wherein a clearance region is provided with a dielectric substance according to an exemplary embodiment of the present invention;

FIG. 10 illustrates an antenna using the antenna radiator according to the present invention, wherein a clearance region is provided with a dielectric substance according to an exemplary embodiment of the present invention;

FIG. 11 illustrates an antenna using the antenna radiator according to the present invention, wherein a clearance region is provided with a dielectric substance according to an exemplary embodiment of the present invention;

Each of FIGS. 12A, 12B, and 12C illustrates an antenna using the antenna radiator according to the present invention, wherein a portion of a clearance region is provided with a dielectric substance according to an exemplary embodiment of the present invention;

FIG. 13 illustrates an antenna using the antenna radiator according to an exemplary embodiment of the present invention, wherein a portion of a radiator configuration circuit is realized on a plane other than that of the ground;

FIG. 14 illustrates an antenna using the antenna radiator according to an exemplary embodiment of the present invention, wherein a portion of a radiator is realized to be protruded outside the clearance region;

FIG. 15 illustrates a graph comparing the performances of the antenna shown in FIG. 7 and the antenna shown in FIG. 9;

FIG. 16 illustrates the inside of a mobile communication terminal having a radiator configuration circuit of the ground radiation antenna according to the present invention installed therein;

FIG. 17 illustrates a ground radiation antenna according to an exemplary embodiment of the present invention;

FIG. 18 illustrates a ground radiation antenna according to an exemplary embodiment of the present invention;

FIG. 19 illustrates a ground radiation antenna according to an exemplary embodiment of the present invention;

FIG. 20 illustrates a ground radiation antenna according to an exemplary embodiment of the present invention;

FIG. 21 illustrates a ground radiation antenna according to an exemplary embodiment of the present invention; and FIG. 22 illustrates an assembly method of the ground radiation antenna according to the present invention.

BEST MODE FOR CARRYING OUT THE INVENTION

In a radiator of an antenna radiating an RF signal by using a ground of a device, it is preferable that an antenna radiator according to the present invention includes a ground formed on a substrate of the device, a capacitor, and a conduction line directly connecting the ground and the capacitor, wherein a portion of the capacitor or the conduction line is formed to be spaced apart from the ground plane.

Additionally, it is preferable that a ground radiation antenna includes a radiator configuration circuit being formed of a conductive line, wherein at least one of both ends of the conductive line is connected to a ground substrate, and wherein at least one portion of the conductive line is protruded from the ground substrate, so as to be formed on a surface other than that of the ground substrate, and a feeding circuit being formed of a conductive line, wherein the feeding circuit includes a feeding point receiving an RF signal that is to be radiated, and wherein at least one portion of the feeding circuit is formed on the substrate.

MODE FOR CARRYING OUT THE INVENTION

While carrying out extensive research and development for implementing a ground radiator having an excellent radiation performance, while having a more simplified structure from the related art ground radiation antenna, the present invention has been devised by observing the essential principles of a ground radiation structure allowing ground radiation to be generated.

In the related art method, efforts have been made to enhance the radiation performance by implementing a separate radiation structure for ground radiation and by modifying the formation or structure of the implemented radiation structure. More specifically, efforts have been made to implement a radiator by combining a structure having both an inductance component and a capacitance component with a capacitor and an inductor.

However, the applicant of the present invention has come to realize that by using the inductance component of the ground, a ground radiation structure having an excellent radiation performance may be built by connecting a capacitor to the ground without requiring any other separate complex structures.

In order to allow the antenna to function as a radiation structure, a capacitor having a capacitance component and an inductor having an inductance component need to exist, so as to generate resonance. Herein, since the ground provides the inductance required to generate the resonance effect, it has become apparent that the antenna can perform the functions of the radiation structure by only using a capacitor and the ground without requiring any separate structure for providing inductance.

However, the related art ground radiators were incapable of efficiently using the inductance component existing in the ground, and, nonetheless, effort has been made to generate resonance by configuring complex structures having the capacitance component and inductance component.

According to the present invention, by efficiently using the inductance existing within the ground itself, resonance may be induced by using a simple structure connecting a capacitor to the ground.

Herein, although it has been mentioned that only the inductance of the ground itself is to be used, more specifically, this indicates that most of the inductance component exist in the ground. For example, the inductance component may also exist in a line connecting the capacitor to the ground. Therefore, in the present invention, the inductance component of the ground refers to the inductance including both the inductance of the ground and the inductance of the line.

Herein, although a capacitor structurally formed on a ground substrate may be provided, it is preferable to use a chip capacitor.

Figure 1:
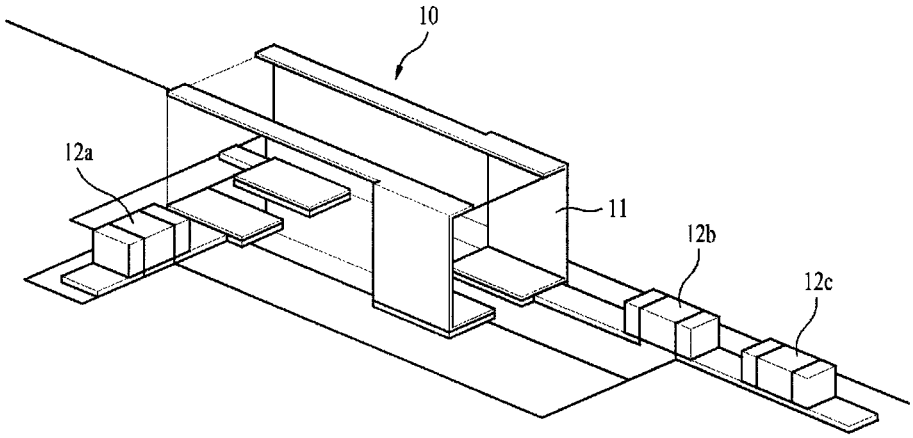
FIG. 1 illustrates an exemplary structural view of a related art ground radiation antenna.
Figure 2:
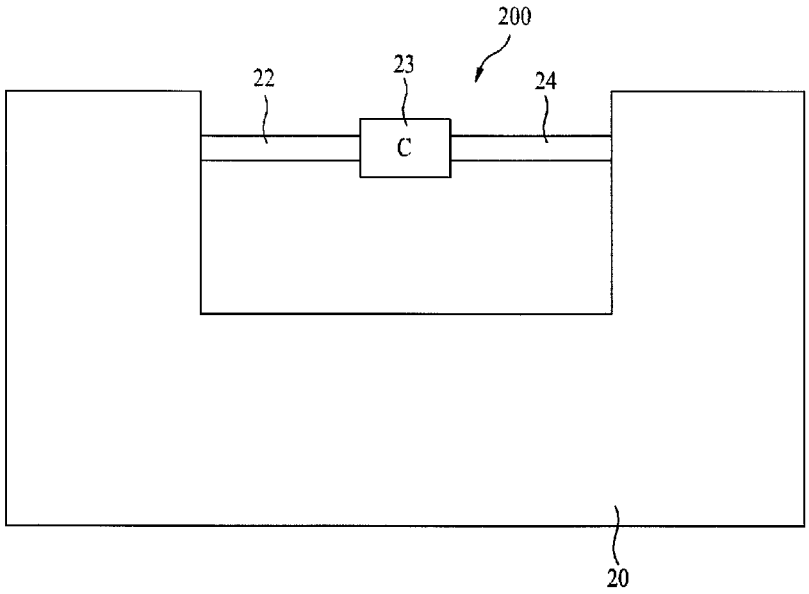
FIG. 2 illustrates a ground radiator according to an embodiment of the present invention.

FIG. 2 illustrates a ground radiator according to an embodiment of the present invention.

As shown in FIG. 2, the ground radiator according to a first exemplary embodiment of the present invention consists of a ground region (20), a first line (22) connecting the ground region (20) and a capacitor (23), a capacitor (23), and a second line (24) connecting the ground region (20) and the capacitor (23).

At this point, the first line (22), the second line (24), and the capacitor (23) form a clearance region (200), and, herein, a clearance refers to a region which is made by removing a portion from ground of mobile terminal.

As described above, according to the present invention, since a resonance frequency can be controlled by using a capacitance of the capacitor (23), an antenna that can easily control the resonance frequency and that has a wide band characteristic may be provided.

Figure 3:
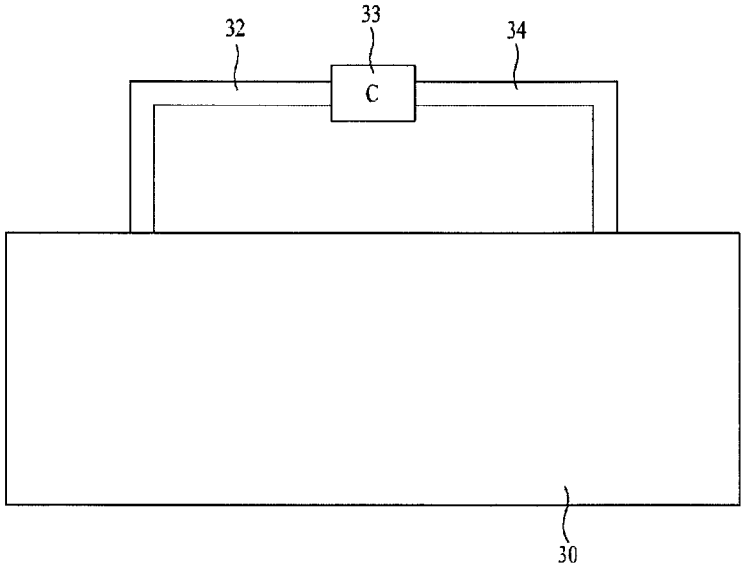
FIG. 3 illustrates a ground radiator according to an embodiment of the present invention.

FIG. 3 illustrates a ground radiator according to an embodiment of the present invention.

As shown in FIG. 3, the ground radiator according to a second exemplary embodiment of the present invention consists of a ground region (30), a first line (32) connecting the ground region (30) and a capacitor (33), a capacitor (33), and a second line (34) connecting the ground region (30) and the capacitor (33).

In this embodiment of the present invention, the ground radiator is configured without forming a clearance on the ground substrate.

Figure 4:
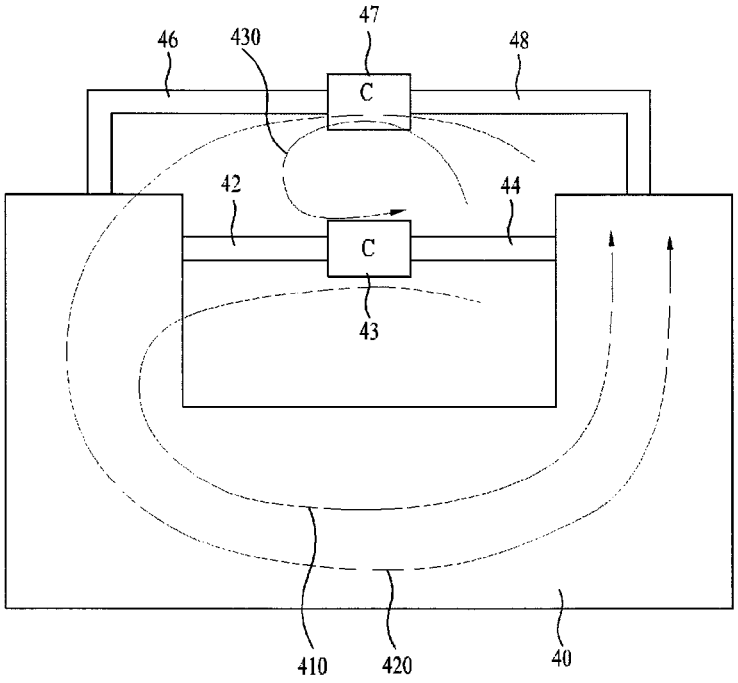
FIG. 4 illustrates a ground radiator according to an embodiment of the present invention.

FIG. 4 illustrates a ground radiator according to an embodiment of the present invention.

As shown in FIG. 4, the ground radiator according to a third exemplary embodiment of the present invention consists of a ground region (40), a first line (42) connecting the ground region (40) and a first capacitor (43), a first capacitor (43), and a second line (44) connecting the ground region (40) and the first capacitor (43), and such connection between the capacitor (43) and the ground (40) may configure a first current loop (410).

Additionally, the ground radiator according to the third embodiment of the present invention also includes a ground region (40), a third line (46) connecting the ground region (40) and a second capacitor (47), a second capacitor (47), and a fourth line (48) connecting the ground region (40) and the second capacitor (47), and such connection between the second capacitor (47) and the ground (40) may configure a second current loop (420).

Furthermore, in addition to the first current loop and the second current loop, a third current loop (430) flowing through the first capacitor (43) and the second capacitor (47) may be configured in the ground radiator according to the third exemplary embodiment of the present invention.

Since resonance occurs in multiple bands due to the above-described multiple loops, an antenna having multiple bands may be configured.

Each of FIGS. 5A, 5B, and 5C illustrates an electric current distribution respective to a frequency being fed to the ground radiator.

FIG. 5A shows an electric current distribution, when a lowest frequency is being fed, and FIG. 5B shows an electric current distribution, when mid-frequency is being fed. Additionally, FIG. 5C shows an electric current distribution, when a highest frequency is being fed. Referring to FIGS. 5A, 5B, and 5C, it is apparent that as the frequency level becomes lower, the distribution of the electric current becomes larger.

Referring to FIGS. 5A, 5B, and 5C, even if a capacitance of the capacitor is fixed, as the electric current distribution varies in accordance with the frequency level, eventually, since an inductance provided by the ground may also vary in accordance with the frequency level, and since resonance occurs in a wide band, it will be apparent that the ground radiator can be operated as an antenna radiator having wideband characteristics.

In addition to the antenna radiator for RF signal radiation, an antenna is also configured of a feeding circuit feeding a signal that is to be radiated. Hereinafter, exemplary examples of an antenna being configured by combining a ground radiator and a feeding circuit according to the present invention will be described in detail.

FIG. 6 illustrates a ground antenna having a ground radiator being configured as a single body with a feeding circuit according to an embodiment of the present invention.

Referring to FIG. 6, a ground radiation antenna using the antenna radiator according to the present invention is configured by including a feeding unit (620) consisting of a feeding point (62) and a feeding line (68), a ground (60), a first line (61), a second line (64*a*), a capacitive element (63), and a third line (64*b*).

The feeding unit (620), the first line (61), the capacitive element (63), and the second line (64*a*) operate as a feeding circuit, which excites the antenna radiation, so that radiation of the RF signal can be realized through the antenna radiator. Additionally, the first line (61), the capacitive element (63), and the second line (64*a*) operate as a configuration circuit of the antenna radiator enabling the RF signal to be actually radiated.

More specifically, in the antenna according to the present invention, the first line (61), the capacitive element (63), and the second line (64*a*) not only correspond to a portion of the feeding circuit included in the antenna, but also correspond to a portion of the radiator configuration circuit.

Meanwhile, the third line (64*b*) is added in order to facilitate impedance matching.

According to the embodiment of the present invention, although it is preferable that the capacitive element corresponds to a lumped circuit element, such as a chip capacitor, in addition to the chip capacitor, a structurally configured capacitive element may also be used. Moreover, the capacitive element may be configured of one capacitor, or the capacitive element may also be configured by connecting two or more capacitors.

Furthermore, a matching element for impedance matching may be inserted to the feeding unit (620) of FIG. 6.

Herein, the antenna radiator refers to a place where the radiation of the RF signal is generally realized, and the feeding circuit refers to a circuit for feeding RF signals in order to operate the ground antenna as the antenna. Therefore, the application of the feeding circuit does not signify that RF signal radiation does not occur at all. Nevertheless, since most of the radiation occurs through the ground radiator, this is referred to as the ground radiator. And, this is identically applied to other exemplary embodiments of the present invention.

As shown in the embodiment of the present invention, when using the radiator according to the present invention, a more simplified antenna having more enhanced radiation efficiency may be realized without configuring a separate radiation structure having a complex structure.

FIG. 7 illustrates an antenna using an antenna radiator according to the present invention.

Referring to FIG. 7, the antenna using the antenna radiator according to the present invention is configured by including a feeding unit (720) consisting of a feeding point (72) and a feeding line (780), a ground (70), a first line (71), a first element (73), a second line (72*a*), a second element (75), a third line (72*b*), a capacitive element (77), a fourth line (74*a*), and a fifth line (74*b*).

The ground (70) provides a reference potential within a communication device, such as a mobile communication terminal, and, herein, it is generally preferable that the user terminal ground is formed on a substrate, wherein circuit elements required for the operation of the user terminal operation are being combined. In the present invention, in addition to the function of providing a reference potential, the ground (70) has the same function as the ground radiator of the antenna, and this will hereinafter be identically applied to other exemplary embodiments of the present invention.

In this embodiment, the feeding unit (720), the first line (71), the first element (73), the second line (72*a*), the second element (75), and the third line (72*b*) operate as a feeding circuit, which excites the antenna radiation, so that radiation of the RF signal can be realized through the antenna radiator. Additionally, the fourth line (74*a*), the capacitive element (77), and the fifth line (74*b*) operate as a configuration circuit of the antenna radiator enabling the RF signal to be actually radiated.

More specifically, in this embodiment, the feeding unit (720), the first line (71), the first element (73), the second line (72*a*), the second element (75), and the third line (72*b*) operate as the feeding circuit, and the fourth line (74*a*), the capacitive element (77), and the fifth line (74*b*) operate as a radiator element of the antenna radiating RF signals in accordance with the feeding of the feeding circuit.

In this embodiment of the present invention, the first element (73) may correspond to an inductive element, a capacitive element, or a simple conducting line. Additionally, the second element (75) may correspond to an inductive element, a capacitive element, or a simple conducting line.

At this point, in case the first element (73) corresponds to a capacitive element, the first line (71), the first element (73), the second line (72*a*), the second element (75), and the third line (72*b*) operate not only as the feeding circuit but also as a radiator configuration circuit, and the antenna according to this embodiment may have multiple band characteristics.

FIG. 8 illustrates a ground antenna having a ground radiator and a feed circuit each being separately configured according to an exemplary embodiment of the present invention.

Referring to FIG. 8, a ground radiation antenna using the antenna radiator according to the present invention is configured by including a feeding unit (820) consisting of a feeding point (82) and a feeding line (88), a ground (80), a first line (81), a second line (84*a*), a first capacitive element (83), a third line (84*b*), a fourth line (86*a*), a second capacitive element (85), and a fifth line (86*b*).

In this embodiment, the feeding unit (820), the first line (81), the second line (84*a*), and the first capacitive element (83) operate as a feeding circuit, which excites the antenna radiation, so that radiation of the RF signal can be realized through the antenna radiator. Additionally, the first line (81), the capacitive element (83), and the second line (84*a*) operate as a configuration circuit of the antenna radiator enabling the RF signal to be actually radiated.

More specifically, in the antenna according to the embodiment of the present invention, the first line (81), the capacitive element (83), and the second line (84*a*) not only correspond to a portion of the feeding circuit included in the antenna, but also correspond to a portion of the antenna radiator configuration circuit.

Meanwhile, the third line (84*b*) is added in order to facilitate impedance matching.

Additionally, the fourth line (86*a*), the second capacitive element (85), and the fifth line (86*b*) operates as the configuration circuit of another antenna radiator.

Accordingly, in this embodiment, a first radiator configuration circuit operating as the antenna radiator and feeding circuit and a second radiator configuration circuit operating only as an antenna radiator may exist.

The antenna according to the embodiment corresponds to a radiator configuration circuit being added to the antenna shown in FIG. 6. More specifically, as described above in this embodiment, the antenna radiator configuration circuit may be separated from the feeding circuit and implemented accordingly.

FIG. 9 illustrates an antenna using the antenna radiator according to the present invention, wherein a clearance region is provided with a dielectric substance according to an exemplary embodiment of the present invention.

The exemplary embodiment shown in FIG. 9 essentially has the same structure as the antenna shown in FIG. 7. However, a dielectric substance having a constant height is positioned in the clearance region of the antenna shown in FIG. 7. Therefore, in a plane view overlooking the antenna of FIG. 9 from above, the antenna of FIG. 9 has the same structure as the antenna of FIG. 7. As shown in FIG. 9, if the radiator configuration circuit and feeding circuit of the antenna are each spaced apart from the ground as much as a predetermined height, a more enhanced antenna radiation characteristic may be provided. More specifically, since the radiation performance of the antenna may be degraded when a substance, such as a conductor, is provided on a lower surface, by spacing such interfering substance and the radiator configuration circuit apart from one another at a predetermined distance, the degradation in the radiation performance may be prevented.

Meanwhile, in the exemplary embodiment of FIG. 9, although the antenna is shown to have a dielectric substance being parallel to the ground surface and having a predetermined height, the height of the left side surface of the dielectric substance may be set to be different from the height of the right side surface of the dielectric substance (so that the dielectric substance can have an inclined structure), or the height of the inner surface of the dielectric substance may be set to be different from the height of the outer surface of the dielectric substance (so that the dielectric substance can have an inclined structure), and such height distribution of the dielectric substance may also be identically applied to the other exemplary embodiments described below.

Furthermore, in the exemplary embodiment of FIG. 9, although the radiator configuration circuit and the feeding circuit are formed on the dielectric substance, the radiator configuration circuit and the feeding circuit may also be realized not to be located on the same plane as the ground without including any dielectric substance (i.e., by using the air as the dielectric substance), and such example of using the air as the dielectric substance may also be identically applied to the other exemplary embodiments described below.

FIG. 10 illustrates an antenna using the antenna radiator according to the present invention, wherein a clearance region is provided with a dielectric substance according to an exemplary embodiment of the present invention.

According to the exemplary embodiment of FIG. 10, although the structure of the antenna is essentially similar to the antenna shown in FIG. 7, the antenna of FIG. 10 is different from that of FIG. 7 in that the feeding circuit is connected to an inner surface of the clearance instead of being connected to a left side surface or right side surface of the clearance region. Meanwhile, the antenna of FIG. 10 has the same characteristics as the antenna of FIG. 9 in that a dielectric substance having a constant height is located in the clearance region.

FIG. 11 illustrates an antenna using the antenna radiator according to the present invention, wherein a clearance region is provided with a dielectric substance according to an exemplary embodiment of the present invention.

The exemplary embodiment shown in FIG. 11 essentially has the same structure (or form) as the antenna shown in FIG. 6. However, a dielectric substance having a constant height is positioned in the clearance region of the antenna shown in FIG. 6. Therefore, in a plane view overlooking the antenna of FIG. 11 from above, the antenna of FIG. 11 has the same structure as the antenna of FIG. 6. As shown in FIG. 11, if the radiator configuration circuit and feeding circuit of the antenna are each spaced apart from the ground as much as a predetermined height, a more enhanced antenna radiation characteristic may be provided.

Each of FIGS. 12A, 12B, and 12C illustrates an antenna using the antenna radiator according to the present invention, wherein a portion of a clearance region is provided with a dielectric substance according to an exemplary embodiment of the present invention.

Each of the exemplary embodiments shown in FIGS. 12A, 12B, and 12C essentially has the same structure as the antenna shown in FIG. 9. However, a dielectric substance having a constant height is positioned in a portion of the clearance region of the antenna shown in FIG. 9. More specifically, the antenna shown in FIG. 12A does not have a dielectric substance located in a left side portion of the clearance and has a dielectric substance located in the rest of the region. Additionally, as shown in FIG. 12A, a conduction line formed on the surface of the dielectric substance and a conduction line formed in the ground or clearance may be connected to one another by a conductive pin passing through the dielectric substance, and, then, the conduction lines are connected to a conduction line formed along a side surface of the dielectric substance. Meanwhile, FIG. 12B and FIG. 12C respectively illustrate other exemplary embodiments of the present invention having the dielectric substance removed from a portion of the clearance.

FIG. 13 illustrates an antenna using the antenna radiator according to an exemplary embodiment of the present invention, wherein a portion of a radiator configuration circuit is realized on a plane other than that of the ground. More specifically, a portion of the radiator configuration circuit is spaced apart from the ground plane at a predetermined distance in order to enhance the antenna performance. In FIG. 13, although only a portion of the radiator configuration circuit is implemented on a plane other than that of the ground, the entire radiator element may be implemented on a plane other than that of the ground.

FIG. 14 illustrates an antenna using the antenna radiator according to an exemplary embodiment of the present invention, wherein a portion of a radiator is realized to be protruded outside the clearance region. More specifically, a portion of the radiator configuration circuit is spaced apart from the ground at a predetermined distance in order to enhance the antenna performance. In FIG. 14, although only a portion of the radiator configuration circuit is implemented to be protruded outside the clearance, the entire radiator element may be implemented on a plane other than that of the ground. As shown in FIG. 14, in case a portion of the antenna radiator is protruded outside the clearance region, the protruded radiator configuration circuit may be formed on a case surface of the corresponding mobile communication terminal.

FIG. 15 illustrates a graph comparing the performances of the antenna shown in FIG. 7 and the antenna shown in FIG. 9. As shown in FIG. 15, if the radiator configuration circuit or feeding circuit is formed to be spaced apart from the ground surface, instead of being formed on the same plane as the ground, it will be apparent that the antenna performed is enhanced.

FIG. 16 illustrates the inside of a mobile communication terminal having a radiator configuration circuit of the ground radiation antenna according to the present invention installed therein.

As shown in FIG. 16, a portion (161) of the radiator configuration circuit has a structure being spaced apart from a surface of a PCB (162), which configures the ground, so as to be protruded from the corresponding surface while leaving an empty space between the portion (161) of the radiator configuration circuit and the surface of the PCB (162). More specifically, instead of being formed on the surface of the PCB (162), the portion (161) of the radiator configuration circuit is formed to vertically protrude from the PCB surface or to protrude along a direction forming a predetermined angle from the PCB surface. Additionally, it is preferable that the portion (161) of the radiator configuration circuit is protruded along a direction opposite to that of an LCD panel (163), which is located to be parallel to the PCB (162).

FIG. 17 illustrates a ground radiation antenna according to an exemplary embodiment of the present invention.

As shown in FIG. 17, the ground radiation antenna according to the present invention is configured to include a feeding circuit (171), and a radiator configuration circuit (172). At this point, an LCD panel is located on a lower surface of the PCB substrate.

In this embodiment, a portion of the feeding circuit (171) is formed on the PCB, and the remaining portion of the feeding circuit (171) connects the feeding circuit (171) formed on the PCB substrate with the radiator configuration circuit (172). The feeding circuit (171) is provided with a feeding point (1711) for receiving an RF signal that is to be radiated. Additionally, as shown in FIG. 2, the feeding circuit (171) may have a lumped circuit element (inductive element or capacitive element) (1712). At this point, the lumped circuit element (1712) may be formed at diverse locations within the feeding circuit (171), and the lumped circuit element (1712) may also be formed of a combination of multiple lumped circuit elements.

A portion (1713) of the PCB ground substrate may be removed, so that the feeding circuit (171), which is formed on the PCB substrate, can be open to the outside.

In this exemplary embodiment, a portion of the radiator configuration circuit (172) is formed on the PCB substrate, and the remaining portion is formed to protrude from the surface of the PCB, while leaving an empty space between the corresponding portion and the surface of the PCB. Both ends of the radiator configuration circuit (172) are connected to PCB ground substrate. Additionally, as shown in FIG. 2, the radiator configuration circuit (172) may have a lumped circuit element (inductive element or capacitive element) (1722). At this point, the lumped circuit element (1722) may be formed at diverse locations within the radiator configuration circuit (172), and the lumped circuit element (1722) may also be formed of a combination of multiple lumped circuit elements. However, as shown in FIG. 2, for simplicity in the implementation of this embodiment, it is preferable to connect the lumped circuit element (1722) to a portion of the radiator configuration circuit (172) formed on the PCB substrate.

FIG. 18 illustrates a ground radiation antenna according to an exemplary embodiment of the present invention.

As shown in FIG. 18(*a*), the ground radiation antenna according to the present invention is configured to include a feeding circuit (181), and a radiator configuration circuit (182). At this point, an LCD panel is located on a lower surface of the PCB substrate.

In this embodiment, the feeding circuit (181) is formed on the PCB. The feeding circuit (181) is provided with a feeding point (1811) for receiving an RF signal that is to be radiated. Additionally, as shown in FIG. 18(*a*), the feeding circuit (181) may have a lumped circuit element (inductive element or capacitive element) (1812). At this point, the lumped circuit element (1812) may be formed at diverse locations within the feeding circuit (181), and the lumped circuit element (1812) may also be formed of a combination of multiple lumped circuit elements.

In this exemplary embodiment, a portion of the radiator configuration circuit (182) is formed on the PCB substrate, and the remaining portion is formed to protrude from the surface of the PCB, while leaving an empty space between the corresponding portion and the surface of the PCB. Both ends of the radiator configuration circuit (182) are connected to PCB ground substrate. Additionally, as shown in FIG. 3(*a*), the radiator configuration circuit (182) may have a lumped circuit element (inductive element or capacitive element) (1822). At this point, the lumped circuit element (1822) may be formed at diverse locations within the radiator configuration circuit (182), and the lumped circuit element (1822) may also be formed of a combination of multiple lumped circuit elements. However, as shown in FIG. 18(*a*), for simplicity in the implementation of this embodiment, it is preferable to connect the lumped circuit element (1822) to a portion of the radiator configuration circuit (182) formed on the PCB substrate.

Additionally, as shown in FIG. 18(*b*), by having the PCB ground substrate surround (or envelope) the feeding circuit (181), unlike the example shown in FIG. 18(*a*), the feeding circuit (181) may be formed to be unexposed to the outside.

FIG. 19 illustrates a ground radiation antenna according to an exemplary embodiment of the present invention.

As shown in FIG. 19, the ground radiation antenna according to the present invention is configured of a radiator configuration circuit (192) formed on an upper surface of the PCB substrate, and a feeding circuit (191) formed on a lower surface of the PCB substrate. At this point, an LCD panel is located on a lower surface of the PCB substrate.

In this embodiment, the feeding circuit (191) is formed on a lower surface of the PCB substrate. The feeding circuit (191) is provided with a feeding point (1911) for receiving an RF signal that is to be radiated. Additionally, as shown in FIG. 19, the feeding circuit (191) may have a lumped circuit element (inductive element or capacitive element) (1912). At this point, the lumped circuit element (1912) may be formed at diverse locations within the feeding circuit (191), and the lumped circuit element (1912) may also be formed of a combination of multiple lumped circuit elements.

In this exemplary embodiment, a portion of the radiator configuration circuit (192) is formed on the upper surface of the PCB substrate, and the remaining portion is formed to protrude from the upper surface of the PCB, while leaving an empty space between the corresponding portion and the upper surface of the PCB. Both ends of the radiator configuration circuit (192) are connected to PCB ground substrate. At this point, both ends or one end of the radiator configuration circuit (192) may be equipped with a connector (1923) for connecting one or both ends of the radiator configuration circuit (192) to the lower surface of the PCB substrate.

Additionally, as shown in FIG. 19, the radiator configuration circuit (192) may have a lumped circuit element (inductive element or capacitive element) (1922). At this point, the lumped circuit element (1922) may be formed at diverse locations within the radiator configuration circuit (192), and the lumped circuit element (1922) may also be formed of a combination of multiple lumped circuit elements. However, as shown in FIG. 19, for simplicity in the implementation of this embodiment, it is preferable to connect the lumped circuit element (1922) to a portion of the radiator configuration circuit (192) formed on the PCB substrate.

FIG. 20 illustrates a ground radiation antenna according to an exemplary embodiment of the present invention.

As shown in FIG. 20, the ground radiation antenna according to the present invention is configured to include a feeding circuit (201), and a radiator configuration circuit (202). At this point, an LCD panel is located on a lower surface of the PCB substrate.

In this embodiment, the feeding circuit (201) is formed on the PCB. The feeding circuit (201) is provided with a feeding point (2011) for receiving an RF signal that is to be radiated. Additionally, as shown in FIG. 5, the feeding circuit (201) may have a lumped circuit element (inductive element or capacitive element) (2012). At this point, the lumped circuit element (2012) may be formed at diverse locations within the feeding circuit (201), and the lumped circuit element (2012) may also be formed of a combination of multiple lumped circuit elements.

In this exemplary embodiment, a portion of the radiator configuration circuit (202) is formed on the PCB substrate, and the remaining portion is formed to protrude from the surface of the PCB, while leaving an empty space between the corresponding portion and the surface of the PCB. Although one end of the radiator configuration circuit (203) is connected to the PCB ground substrate, the other end is not connected to the PCB ground substrate.

As shown in FIG. 20, the radiator configuration circuit (202) may have a lumped circuit element (inductive element or capacitive element) (2022). At this point, the lumped circuit element (2022) may be formed at diverse locations within the radiator configuration circuit (202), and the lumped circuit element (2022) may also be formed of a combination of multiple lumped circuit elements. However, as shown in FIG. 20, for simplicity in the implementation of this embodiment, it is preferable to connect the lumped circuit element (2022) to a portion of the radiator configuration circuit (202) formed on the PCB substrate.

FIG. 21 illustrates a ground radiation antenna according to an exemplary embodiment of the present invention.

As shown in FIG. 21, the ground radiation antenna according to the present invention is configured to include a feeding circuit (211), and a radiator configuration circuit (212). At this point, an LCD panel is located on a lower surface of the PCB substrate.

In this embodiment, a portion of the feeding circuit (211) is formed on the PCB, and the remaining portion connects the feeding circuit (211) formed on the PCB substrate to the radiator configuration circuit (212). The feeding circuit (211) is provided with a feeding point (2111) for receiving an RF signal that is to be radiated. Additionally, as shown in FIG. 2, the feeding circuit (21) may have a lumped circuit element (inductive element or capacitive element) (2112). At this point, the lumped circuit element (2112) may be formed at diverse locations within the feeding circuit (211), and the lumped circuit element (2112) may also be formed of a combination of multiple lumped circuit elements.

In this exemplary embodiment, a portion of the radiator configuration circuit (212) is formed on the PCB substrate, and the remaining portion is formed to protrude from the surface of the PCB, while leaving an empty space between the corresponding portion and the surface of the PCB. Although one end portion of the radiator configuration circuit (213) is connected to the PCB ground substrate, the other end portion is not connected to the PCB ground substrate.

Additionally, as shown in FIG. 21, the radiator configuration circuit (212) may have a lumped circuit element (inductive element or capacitive element) (2122). At this point, the lumped circuit element (2122) may be formed at diverse locations within the radiator configuration circuit (212), and the lumped circuit element (2122) may also be formed of a combination of multiple lumped circuit elements. However, as shown in FIG. 6, for simplicity in the implementation of this embodiment, it is preferable to connect the lumped circuit element (2122) to a portion of the radiator configuration circuit (212) formed on the PCB substrate.

The ground radiation antenna according to the exemplary embodiment of the present invention may have a dual band characteristic.

FIG. 22 illustrates a assembly method of the ground radiation antenna according to the present invention.

The ground radiation antenna according to the present invention requires a radiator configuration circuit having at least one end connected to a PCB ground substrate and being protruded upward (a direction opposite to that of a conductive element, such as LCD, and so on) from the PCB ground substrate while maintaining an empty space there between. Accordingly, a method for more easily assembling such radiator configuration circuit is being required.

First of all, one of the methods for assembling the radiator configuration circuit according to the present invention corresponds to a method of fabricating a "ㄷ" shaped conduction line and connecting the conduction line to the PCB ground by making the conduction line stand. However, in case of creating the"ㄷ" shaped conduction line, the productivity may be degraded.

Therefore, as shown in FIG. 22, after forming a conduction line pattern (225) on one side of a cover (221) part of the mobile communication terminal (or user terminal), and after forming a feeding circuit (223) and pillar-shaped connection lines (224*a*, 224*b*) on another side (222), when one side of the cover (221) is coupled with the other side (222) cover, it is preferable that to complete the assembly of the radiator configuration circuit by finally connecting the radiator configuration circuit.

As described above, when configuring an antenna by using the radiator according to the present invention, whether the radiator is configured as a single body with a radiator configuration circuit, or whether the radiator is configured separately, an antenna having a remarkably simple structure and having an excellent radiation efficiency may be implemented without having to configure a radiation structure having a complex structure.

In addition to the above-described exemplary embodiments of the present invention, by combining the radiator according to the present invention with diverse forms of feeding circuits, diverse forms of ground radiation antennae may be implemented.

INDUSTRIAL APPLICABILITY

The antenna according to the present invention may be used in mobile communication terminals (or user terminals).

What is claimed is:

1. A ground radiation antenna for a mobile terminal, the ground radiation antenna being formed on a PCB (Printed Circuit Board) having a ground substrate, the ground radiation antenna comprising:

a radiator configuration circuit including first, second and third conductive lines, wherein the first and second conductive lines are perpendicularly positioned on the PCB and lower ends of the first and second conductive lines are connected to the ground substrate, and the third conductive line is formed on a cover of the mobile terminal, wherein when the cover is coupled to the mobile terminal, the third conductive line is electrically connected to upper ends of the first and second conductive lines, respectively; and a feeding circuit including a fourth conductive line formed on the PCB, wherein the feeding circuit includes a feeding point receiving an RF signal that is to be radiated.

2. The ground radiation antenna of claim 1, wherein the third conductive line is formed of a conduction line pattern on one side of the cover of the mobile terminal.

3. The ground radiation antenna of claim 1, wherein the first and second conductive lines are formed of pillar-shaped connection lines.

4. The ground radiation antenna of claim 1, wherein the radiator configuration circuit includes a lumped circuit element.

5. The ground radiation antenna of claim 1, wherein the lumped circuit element is formed on the PCB.

* * * * *